US006237880B1

(12) United States Patent
McNutly

(10) Patent No.: US 6,237,880 B1
(45) Date of Patent: May 29, 2001

(54) MOP STAND

(76) Inventor: Stanley McNutly, 123 Indianwood, Park Forest, IL (US) 60466

( * ) Notice: Subject to any disclaimer, the term of this patent is extended or adjusted under 35 U.S.C. 154(b) by 0 days.

(21) Appl. No.: 09/229,072

(22) Filed: Jan. 12, 1999

(51) Int. Cl.[7] ..... A47B 81/02; B65D 81/26
(52) U.S. Cl. ..... 248/146; 211/65; 206/209
(58) Field of Search ..... 248/146, 150, 248/154, 176.1, 110, 111, 121, 532, 314, 910; 15/260, 264; D32/53, 58, 59; 211/62, 63, 65, 70; 206/209

(56) References Cited

U.S. PATENT DOCUMENTS

| | | | | |
|---|---|---|---|---|
| 1,063,709 | * | 6/1913 | Marsden | 248/201 |
| 1,303,171 | * | 5/1919 | Curtin | 248/146 |
| 1,333,616 | * | 3/1920 | Hall et al. | 248/117.1 |
| 1,485,510 | * | 3/1924 | Kron | 248/314 |
| 1,972,532 | * | 9/1934 | McMillan | 248/111 |
| 2,112,944 | * | 4/1938 | Wolcott | 141/341 |
| 2,187,974 | * | 1/1940 | Johnson | 141/340 |
| 2,200,435 | * | 5/1940 | Thrasher | 248/111 |
| 2,623,642 | * | 12/1952 | Looney | 211/65 |
| 2,820,685 | * | 1/1958 | Bergholt | 312/207 |
| 2,902,145 | * | 9/1959 | Wagner | 206/362.1 |
| 3,344,930 | * | 10/1967 | Merkel | 211/65 |
| 3,780,874 | * | 12/1973 | Stacy, Sr. | 211/65 |
| 4,214,657 | * | 7/1980 | Winston | 206/209.1 |
| 4,583,577 | * | 4/1986 | Canfield | 150/52 R |
| 5,052,649 | * | 10/1991 | Hunnicutt | 248/311.2 |
| 5,639,055 | * | 6/1997 | Fritz | 248/910 |
| 5,769,245 | * | 6/1998 | Butler | 211/65 |

FOREIGN PATENT DOCUMENTS

| | | | | |
|---|---|---|---|---|
| 266519 | * | 4/1950 | (CH) | 211/65 |
| 755351 | * | 8/1956 | (GB) | 211/65 |

* cited by examiner

*Primary Examiner*—Ramon O Ramirez
*Assistant Examiner*—Jon Szumny

(57) ABSTRACT

A device for supporting a mop in an inverted position, comprising a tip half supporting a drying material that will not permit a wet mop head's moisture to drip onto the floor. The invention also comprises a bottom half that supports a mop handle and can be attached to the top half by a locking device.

7 Claims, 1 Drawing Sheet

MOP STAND

BACKGROUND OF THE INVENTION

1. The invention is a use of absorbing material such as a sponge along with a supporting device to allow a mop head to dry while being supported in an inverted position.

2. No mop head until now has been dried in this inverted position with a removable drying material that doesn't permit the moisture of the mop to drip to the floor or ground that would cause more work for the user.

SUMMARY OF THE INVENTION

By using the mop stand, a person can dry their mop heads without the thought of a smelly mop being stored in their house. The removable drying material solves this problem. The drying material can be removed and placed into a washing machine for cleaning.

Because the upper and lower structures are slightly wider than the mop head itself, the mop when placed in the mop stand can be neatly stored in an out of the way corner of the home. The handle on the top half of the mop stand, allows for easy pick up and transport of the device when not in use. The twist hold downs and their slots join the upper and lower halves together forming a single piece to carry. The base when weighted down with a material such as sand will support the mop for the drying time of the mop head.

FIG, 4 is a side cut away view of drying material, such as a sponge.

Figure 5:
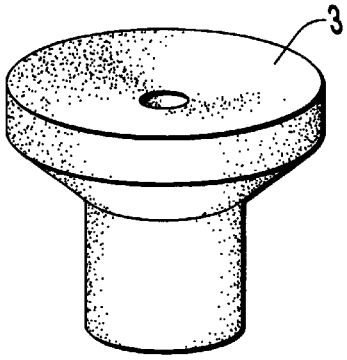

FIG. 5 is a side view of a drying material, slightly tilted forward.

DESCRIPTION OF THE PREFERRED EMBODIMENT

Figure 1:
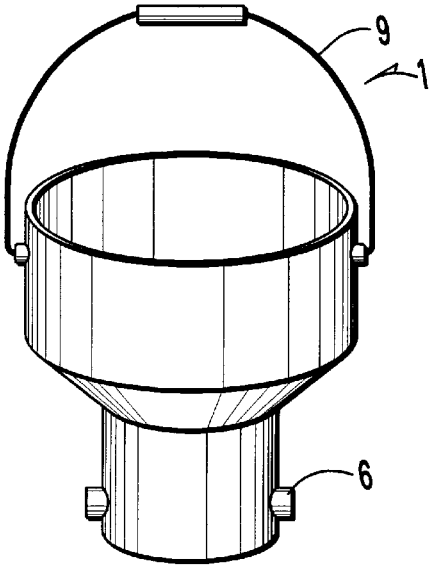
FIG. 1 is a side view of the upper section of the mop stand, in a slightly tilted forward position.

Referring to FIGS. 1, 2, 3, 4, and 5 an embodiment of the mop stand is shown, In this embodiment, the mop stand comprise an upper section 1, a lower section 2, and a drying material 3 in FIG. 5 that fits into the upper section 1 of FIG. 1.

The material 3 comprised an absorbent fabric that will retain liquid falling from the mop head. The mop stand has a handle 9 in FIG. 1 that allows the mop Stan to be easily transported.

Figure 3:
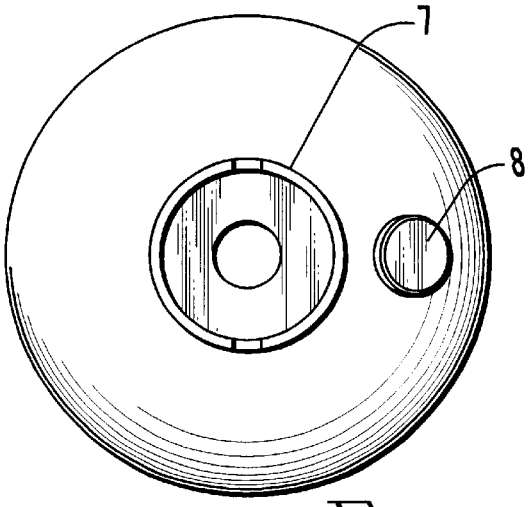
FIG. 3 is the top view of the lower section in FIG. 2.
Figure 2:
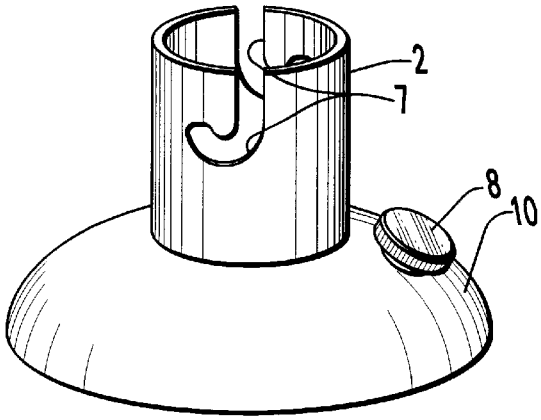
FIG. 2 is the side view of the lower section of the mop stand, in a slightly tilted forward position.
Figure 4:
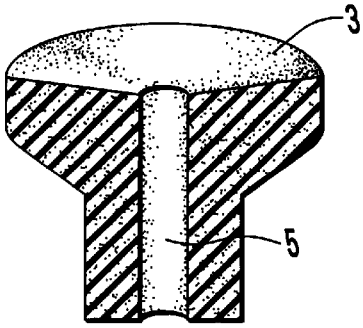

The drying material 3 has a hole 5 down its center permitting a mop handle to pass through with a slight snug fit upon the mop handle. The upper section 1 has twist hold downs 6 for being placed into the push down twist slots 5 on lower section 2 for holding the two sections together. FIG. 3 shows a top view of a twist off cap 8 which is the means for adding weight to the lower section. FIG. 2 shows a side view of the twist off cap 8.

The base 10 of the lower section 2, when weighted down with a material such as sand, is wide enough to support the entire unit along with a mop with a wet mop head. The upper and lower sections are both made of a material such as a plastic, which is firm yet light in weight.

I claim:

1. A mop-stand combination comprising in combination:

a mop having a mop head and an elongate mop handle, said mop handle having a first end and a second end, and said mop head affixed to said second end of said handle;

a first stand member comprised of an upwardly-open receptacle element and a downwardly-open neck element;

a moisture absorbent material supported in said first stand member; and a second stand member comprised of an upright sleeve element protruding upwardly from a base element, said first stand member releasably seated upon said mop handle, said neck element encircling said mop handle;

said first end of said handle releasably seated within said sleeve element, said base element being weighted to support said mop in an upright inverted position, and wherein said base element includes a fill port for weighting material and a closure for said fill port.

2. The mop-stand of claim 1, further including means for releasably locking together said first stand member and said second stand member.

3. The mop-stand combination of claim 1, wherein said first stand member includes a plurality of twist hold down elements and said second stand member includes a plurality of push down twist slots.

4. The mop-stand combination of claim 1, wherein said neck element includes a plurality of twist hold down elements and said sleeve element includes a plurality of push down twist slots.

5. The mop-stand combination of claim 1, wherein said moisture absorbent material comprises a plug of absorbent fabric.

6. The mop-stand of claim 1, wherein said moisture absorbent material at least partially lines said receptacle element and said neck element.

7. The mop-stand combination of claim 1, wherein said base element includes a fill port for weighting material and a closure for said fill port, said neck element includes a plurality of twist hold down elements and said sleeve element including a plurality of push down twist slots, said moisture absorbent material comprises a plug of absorbent material, and said plug of absorbent material at least partially lines said receptacle element and said neck element.

* * * * *